US005472336A

United States Patent [19]

Adams et al.

[11] Patent Number: 5,472,336

[45] Date of Patent: Dec. 5, 1995

[54] FLAME RECTIFICATION SENSOR EMPLOYING PULSED EXCITATION

[75] Inventors: John T. Adams, Minneapolis; John E. Bohan, Jr., Edina, both of Minn.; Richard W. Simons, University Heights, Ohio

[73] Assignee: Honeywell Inc., Minneapolis, Minn.

[21] Appl. No.: 99,667

[22] Filed: Jul. 29, 1993

Related U.S. Application Data

[63] Continuation-in-part of Ser. No. 68,825, May 28, 1993, abandoned.

[51] Int. Cl.[6] ..... F23N 5/00

[52] U.S. Cl. ..... 431/6; 431/2; 431/25; 431/16

[58] Field of Search ..... 431/6, 25, 13, 431/24, 26, 16; 340/579

[56] References Cited

U.S. PATENT DOCUMENTS

| | | | |
|---|---|---|---|
| 3,576,556 | 4/1971 | Sellors, Jr. | 431/78 |
| 3,781,161 | 12/1973 | Schuss | 431/16 |
| 4,243,372 | 1/1981 | Cade | 431/31 |
| 4,295,129 | 10/1981 | Cade | 340/520 |
| 4,444,551 | 4/1984 | Mueller et al. | 431/25 |
| 4,672,324 | 6/1987 | van Kampen | 431/25 X |
| 4,955,806 | 9/1990 | Grunden et al. | 431/25 X |

FOREIGN PATENT DOCUMENTS

| | | |
|---|---|---|
| 60-057124 | 4/1985 | Japan . |
| 60-232422 | 11/1985 | Japan . |
| 20871117 | 5/1982 | United Kingdom . |

*Primary Examiner*—Carl D. Price
*Attorney, Agent, or Firm*—Charles L. Rubow

[57] ABSTRACT

A flame rectification type flame sensor circuit and method in which a generator injects periodic pulses of alternating voltage into a flame region, the voltage across the flame region being processed by a filter/amplifier which, in proper operation, produces a non-zero output signal only during the time a flame is present and a pulse of alternating voltage is being supplied by the generator. Final indication of a flame is produced only if a non-zero output signal occurs during the time a pulse of alternating voltage is being supplied, and not during the time between successive pulses of alternating voltage. Failure of an electrical component in the filter/amplifier is indicated if a non-zero output signal occurs during the time between successive pulses of alternating voltage.

12 Claims, 5 Drawing Sheets

SWITCHABLE AC DRIVE
CONTROL ELECTRONICS
FLAME AMPLIFIER AND FILTER
T1
T1
51
52
55
57
58
59
60
62
63
64
65
66
67
68
69
70
72
73
74
75
76
77
78
80
81
82
83
84
85
87
88

FLAME RECTIFICATION SENSOR EMPLOYING PULSED EXCITATION

CROSS-REFERENCE TO RELATED APPLICATION

This application is a continuation-in-part of pending U.S. patent application Ser. No. 08/068825 filed May 28, 1993 in the name of Richard W. Simons.

BACKGROUND OF THE INVENTION

The present invention relates generally to flame detectors and detection methods based on electric current rectification properties of a flame, and, more specifically, to such a detector and detection method employing periodic pulses of alternating current excitation in a manner to permit detection of inoperable electrical components which could result in flame detection errors.

Combustion systems, such as those used in furnaces, boilers and other appliances in which controlled burning takes place, commonly utilize automatic control systems to ignite, control the flow of, and monitor the combustion of a fuel, such as natural gas, oil, etc. One of the required functions for such an automatic control system is to monitor the flame, and, in its absence, terminate the flow of the fuel to avoid serious hazards. Thus, it is essential that any flame detection apparatus in such a system be designed and constructed to operate in a highly reliable manner.

One well known technique for detecting the presence of a flame is based on electrical properties associated with the flame. As a flame burns, it produces an ionized region in its vicinity, thereby providing an electrically conductive medium. This property can be utilized in conjunction with a probe placed into the flame, and a grounded metal burner to produce a usable electrical signal. If such apparatus is constructed with an effective grounded burner area greater than the effective probe area, typically in at least a 4 to 1 ratio, the flame will exhibit electrical characteristics somewhat similar to those of a diode in series with a 10 megohm resistor. If an alternating current signal is injected into the flame by the probe, the signal will be rectified by the flame. Appropriate filtering and amplification circuitry may then be employed to extract the rectified signal.

Two practical applications of this technique are illustrated in FIGS. 1 and 3, which are schematic diagrams of previously known systems. FIG. 1 illustrates a shunt topology implementation in which an alternating current drive generator is connected electrically in parallel with the burner/flame/probe system. If a flame is present, a voltage divider will be formed during the positive excursions of the AC drive signal. This will have the effect of developing a negative bias on the AC signal at the input of a flame filter/amplifier generally designed to remove the AC component, leaving only a DC signal indicative of the presence or absence of a flame. A signal indicating absence of a flame is typically used to terminate the supply of fuel to the burner. It may also be used to produce a visual warning of system failure.

FIG. 3 illustrates a series topology implementation of the prior flame rectification detection technique. The requirements for the detector system components are generally the same as for those in the shunt topology implementation, except that current, rather than voltage, signals are processed.

Because the circuitry for performing the filtering and amplifying is considered safety related, industry standards require that first and second level failure modes must not compromise its function. This requirement has led to the use of redundant circuit elements, adding expense, leakage paths and crowded circuit board conditions. Thus, a need exists for a flame detector design which provides fail safe operation without requiring redundant components.

SUMMARY OF THE INVENTION

The invention is a flame sensing system and method based on electric current rectification properties of a flame, the system and method utilizing pulsed alternating current excitation in a manner to avoid flame indication errors resulting from electrical component failures, without requiring redundant components. The system includes a drive generator for exciting a pair of electrodes in a flame region with periodic pulses of alternating current which are imparted with an electrical bias if a flame is present. A filter/amplifier attenuates the AC component of current between the electrodes, leaving a DC signal corresponding to presence or absence of a flame. Output logic is operable to indicate presence of a flame only if the DC signal corresponds to presence of flame during the time the electrodes are being excited with a pulse of alternating current, and does not correspond to presence of a flame during the time between excitation with successive pulses of alternating current. A DC signal corresponding to presence of a flame during the time between excitation of the electrodes with successive pulses of alternating current indicates failure of a system component, thereby permitting fail safe operation.

A specific objective of the invention is to provide a flame detector design which requires a minimum number of components in the sensitive, high impedance portion of the filter/amplifier circuitry.

A further objective is to provide a design which allows reliable detection of loss of flame in a substantially shorter time than the current industry standard of 0.8 seconds.

Yet, a further objective is to provide a design which permits detection of failure of critical components in the filter/amplifier circuitry substantially any time during its operation, and not just at the beginning of a flame cycle.

DESCRIPTION OF THE PREFERRED EMBODIMENT

Figure 1:
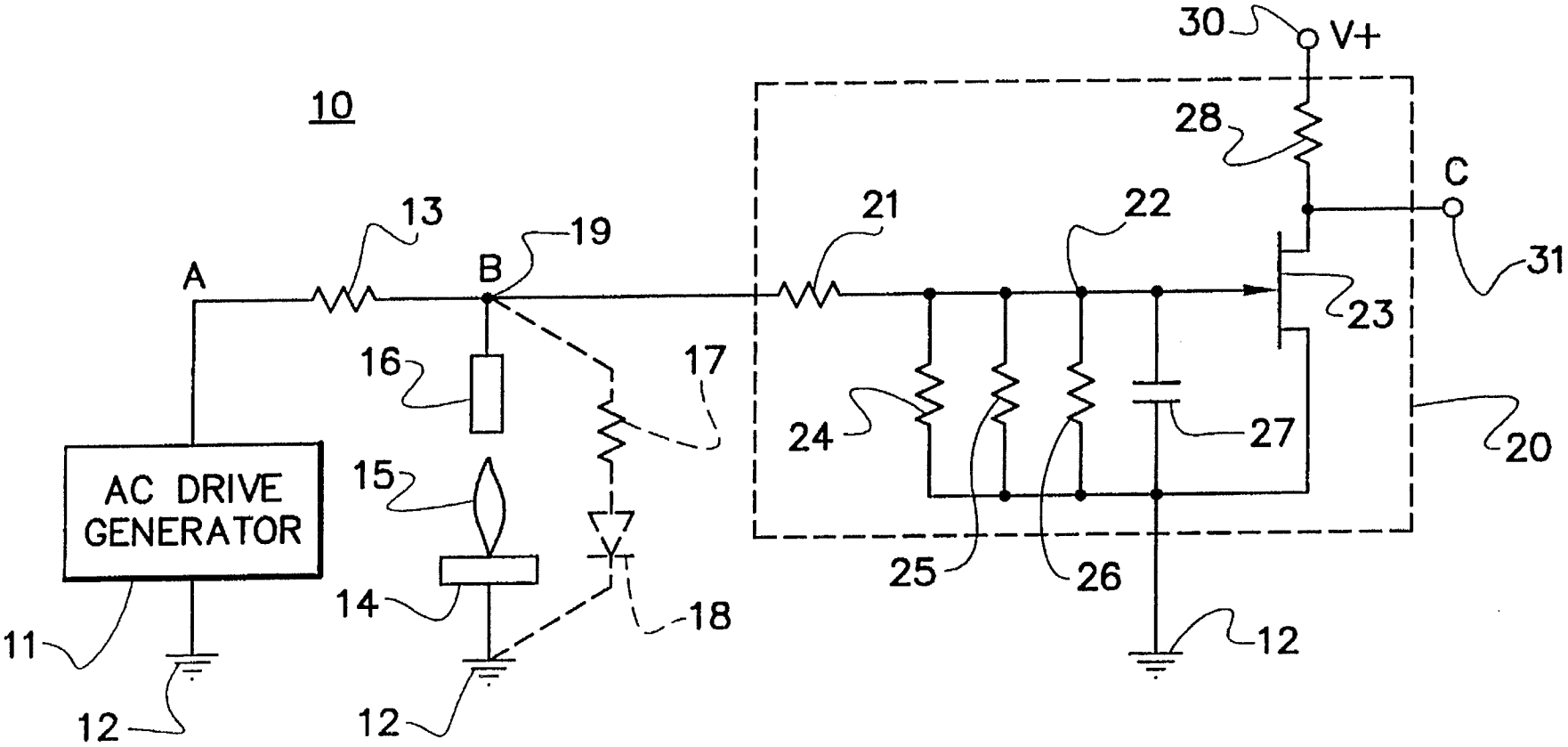
Fig. 1 PRIOR ART
FIG. 1 is a schematic diagram of a prior art rectification type flame sensor employing a shunt circuit topology design.

Referring to FIG. 1, reference numeral 10 generally identifies a shunt topology form of a prior art flame sensing system based on the electric current rectification characteristics of a flame. System 10 is shown as including an alternating current drive generator 11 in series with a resistor 13 connected across a burner apparatus having a flame sensing electrode. Both generator 11 and the burner apparatus are electrically referenced to ground 12.

With particular reference to the burner system, metal burner apparatus 14 is electrically connected to ground 12, the burner apparatus being adapted to support a flame 15 in a flame region. A flame probe 16, which extends into the flame region, is connected to generator 11 through resistor 13 so as to be excited by the alternating current produced by the generator. Burner apparatus 14 conventionally is constructed to have a effective grounded area of at least four times the effective area of probe 16, thereby, in conjunction with flame 15, effectively forming an electrical rectifier. As shown in dashed line symbols in parallel with burner 14 and probe 16, the burner/flame/probe arrangement electrically roughly appears as a resistor 17 in series with a diode 18, the resistor having a high resistance value, typically on the order of 10 megohms.

A node 19 between resistor 13 and probe 16 is connected to a filter/amplifier 20. Filter/amplifier 20 includes a first resistor 21 between node 19 and a node 22, which is connected to the gate electrode of a field effect transistor (FET) 23.

As shown in FIG. 1, three resistors, identified by reference numerals 24, 25 and 26, and a capacitor 27 are connected in parallel between node 22 and ground 12. FET 23 is connected through its source and drain electrodes in series with a resistor 28 between a positive voltage supply terminal 30 and ground 12. The output signal of filter/amplifier 20 is produced at a terminal 31 connected between FET 23 and resistor 28.

In operation, the burner/flame/probe system imparts a negative bias to the AC excitation signal. Resistor 21 and capacitor 27 form a low-pass filter which extracts the DC component from the rectified excitation signal. FET 23 detects the DC level at the output of the filter. In particular, FET 23 becomes nonconducting when the signal at node 22 corresponds to presence of a flame.

A bleed resistor in parallel with capacitor 27 is required to drain off the charge on the capacitor when the flame is lost. This is a critical function, since the automatic control system must act to shut off the flow of fuel in the absence of a flame to avoid a hazardous situation. Therefore, redundant resistors 24, 25 and 26 are provided so that, in the absence of flame, the charge on capacitor 27 will drain off, even if two of these resistors fail in an open circuit condition.

The foregoing requirement adds cost and complexity to the circuit. Further, because the flame presents a high impedance, extraordinary techniques must be used in the filtering and amplifying circuitry. In particular, the impedances of the filter elements must also be in the 50 megohm range to avoid excessive loading of the 10 megohm impedance of the flame. The redundant components add potentially problematic leakage paths, thereby compromising circuit reliably, and limiting its use.

Figure 2:
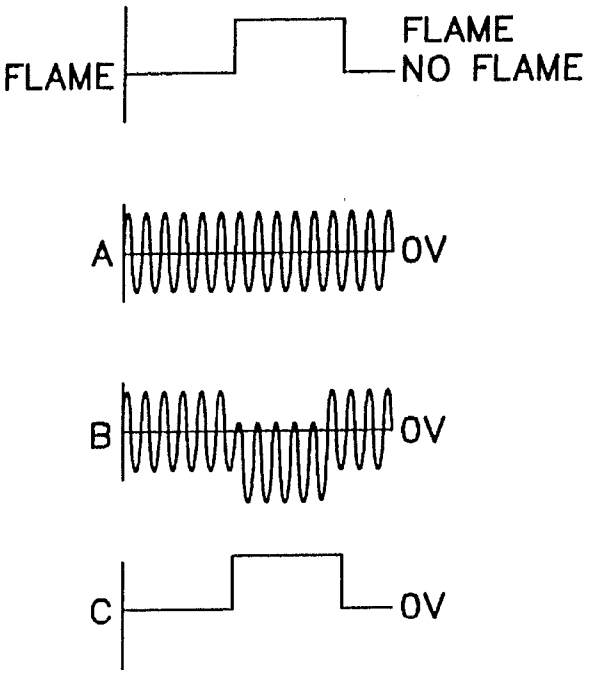
PRIOR ART Fig. 2
FIG. 2 is a representation of signal waveforms at indicated points in the sensor of FIG. 1.

The waveforms which occur at designated points in the flame sensor of FIG. 1 during its operation are illustrated in FIG. 2, in which the top waveform indicates a short interval during which flame 15 is present. The second waveform illustrates a relatively high frequency AC signal produced by drive generator 11, which is present at point A in the sensor of FIG. 1. The third waveform in FIG. 2 shows that during the interval when flame 15 is present, the excitation signal is rectified to produce at point B a voltage having attenuated positive values. This signal forms the input to filter/amplifier 20 which removes the AC component, as has been described, to provide at point C a signal as illustrated by the bottom waveform in FIG. 2. This signal is indicative of presence or absence of a flame.

Figure 3:
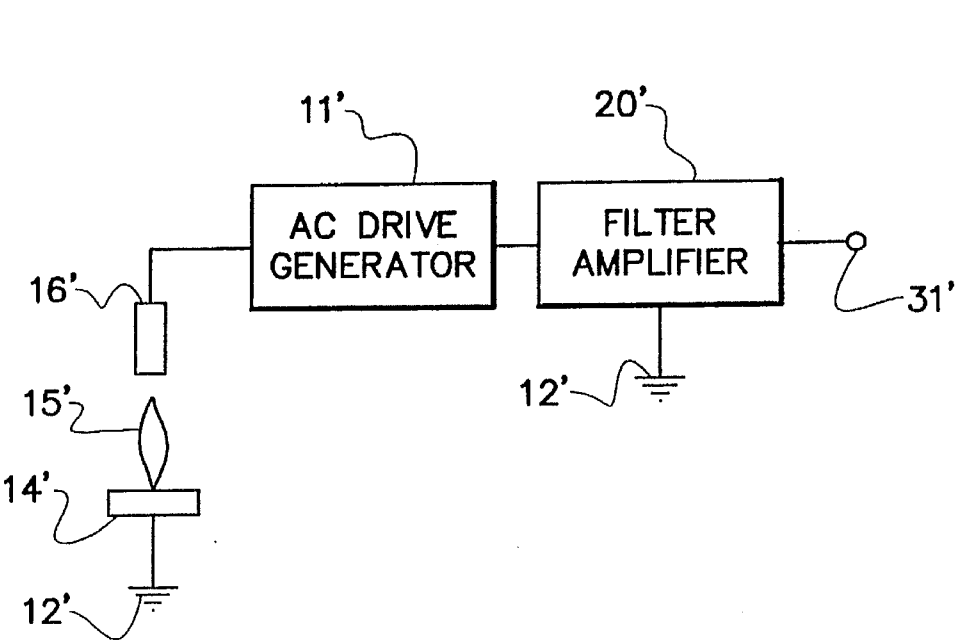
PRIOR ART Fig. 3
FIG. 3 is a block diagram of a prior art rectification type flame sensor employing a series circuit topology design.

In the prior art series topology implementation of FIG. 3, various elements corresponding to those in FIG. 1 are rearranged such that drive generator 11' is connected in series between probe 16' and filter/amplifier 20'. This series combination is, in turn, effectively connected in series with burner 14' and flame 15' between ground 12' and output terminal 31'.

By way of context and background for the applicants' invention, two of the design requirements for the control system under consideration were that it be polarity insensitive, and that it operate in the presence of condensed moisture. These requirements particularly impact the flame sensor circuitry. When water condenses on high impedance filter/amplifier components, leakage paths are created physically across the bodies of the components and between the various electrical nodes. These leakage paths can completely attenuate the flame signal. This situation can be improved by (1) reducing the number of components across which leakage paths can occur, (2) maximizing physical separation of the components, both lead to lead and node to node, and (3) driving the filter/amplifier with as large a signal as possible.

For the particular application for which the disclosed implementation was designed, a transformer based voltage step up circuit is employed to provide polarity insensitivity. However, it is pointed out that the inventive concept is useful in applications not requiring polarity insensitivity, and that polarity insensitivity can be provided by means other than a transformer based step up circuit.

By designing the disclosed step up circuit to produce as high a frequency as possible, the cost of magnetic components is minimized, along with the number of poles required in the filter/amplifier. Minimizing the number of filter poles also minimizes the number of high impedance nodes and components, and allows the remaining components to be spread out as much as possible within the packaging constraints.

The upper frequency limit is determined by the stray capacitance to ground of the flame detection probe system and of the flame itself. This capacitance, when combined with the series impedance of the flame sensor power supply, forms a first order low pass filter. Experimental results indicate that 40 KHz is the upper limit. 30 KHz is a practical compromise between design margin and magnetic component costs.

An additional advantage of the high operating frequency is that it reduces the sensor response time to loss of flame. It also permits use of a single pole filter having a short decay response time. The short decay time allows a design approach which eliminates the need for the FMEA-required triple parallel high resistance resistors otherwise required for reliability in draining off the charge from the filter capacitor. In particular, control electronics, which will be described in greater detail hereinafter, turns the high frequency, high voltage flame probe excitation signal on and off at a 5 Hz rate. In the presence of a flame, the control electronics processor will see a similar 5 Hz signal at the output of the flame amplifier. If the single bleed resistor opens, the capacitor will remain charged and the control electronics will determine that the flame probe detection signal no longer matches the flame probe drive signal. Such operation may also be used to detect a number of other component failures.

Figure 4:
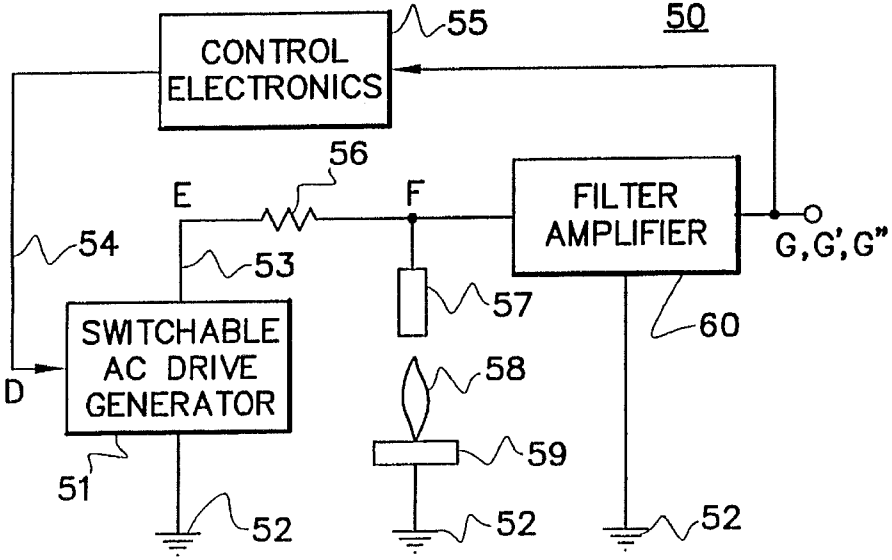
FIG. 4 is a block diagram of a rectification type flame sensor in accordance with the applicants' invention.

Turning to FIG. 4, reference numeral 50 generally identifies a shunt topology version of a flame sensor in accordance with the applicants' invention. System 50 includes an alternating current drive generator 51 referenced to an electrical ground 52, and operable to produce an alternating current excitation signal on an output conductor 53. Generation of the excitation signal is controlled by a signal on a control conductor 54 provided by control electronics 55. As will be described hereinafter, the control electronics are designed to produce a square wave, shown as waveform D in FIG. 5, having a predetermined repetition rate. As previously indicated, repetition rate of five repetitions per second for the control signal, and a frequency of 30 KHz for the alternating current excitation signal, have been found suitable for the sensor of FIG. 4. Drive generator 51 and control electronics cooperate to form a signal generator which produces an alternating voltage within a square wave envelope.

In the disclosed implementation, the excitation signal on conductor 53 is supplied through a resistor 56 to a flame probe or injector electrode 57 which extends into the flame region of a flame 58 sustained by metal burner apparatus 59, which is electrically referenced to ground 52. Burner 59, thus, functions as a reference electrode for the flame sensing system. This circuit could also be implemented with a capacitor in place of resistor 56.

Figure 5:
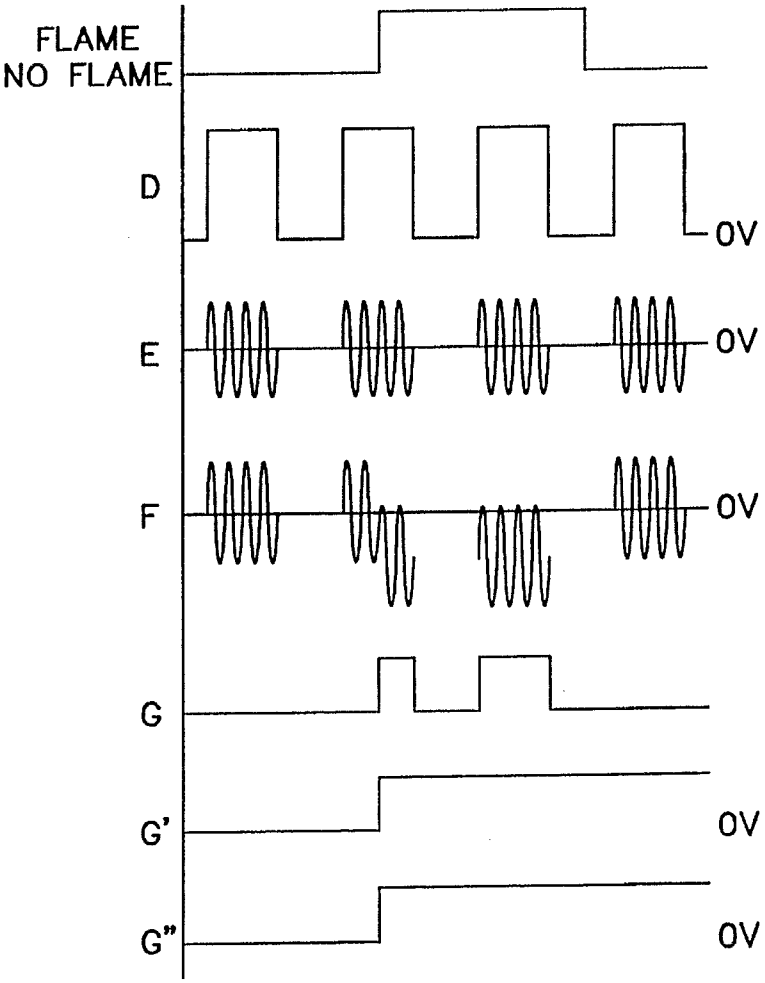
FIG. 5 is a representation of signal waveforms at various points in the system of FIG. 4, and showing the normal system output, as well as system outputs when certain component failures exist.

As illustrated by waveform E in FIG. 5, drive generator 51 produces periodic pulses of alternating current which are supplied through resistor 56, or through a corresponding capacitor, to flame probe 57. With no flame present in the flame region, no electrical path to ground is provided through flame probe 57 and burner apparatus 59. In that event, the signal at the flame probe is centered about 0 volts, in accordance with the excitation signal produced by generator 51. However, if a flame is present in the flame region, a shunt electrical path to ground 52 is provided through probe 57, flame 58 and burner apparatus 59 during positive excursions of the voltage supplied to probe 57. This has the effect of impressing a negative bias on the signal at the flame probe, as illustrated by a portion of waveform F in FIG. 5. It is pointed out that although the circuit implementation specifically illustrated in FIGS. 4 and 6 produces a negatively biased signal when flame is sensed, the circuit could as easily be implemented to produce a signal having a unipolar bias of either polarity.

The signal at flame probe 57 is supplied to a filter/amplifier 60 referenced to ground 52 in which the AC component of the signal is removed, leaving only a DC signal corresponding to the envelope of the AC signal when flame is present.

Figure 6:
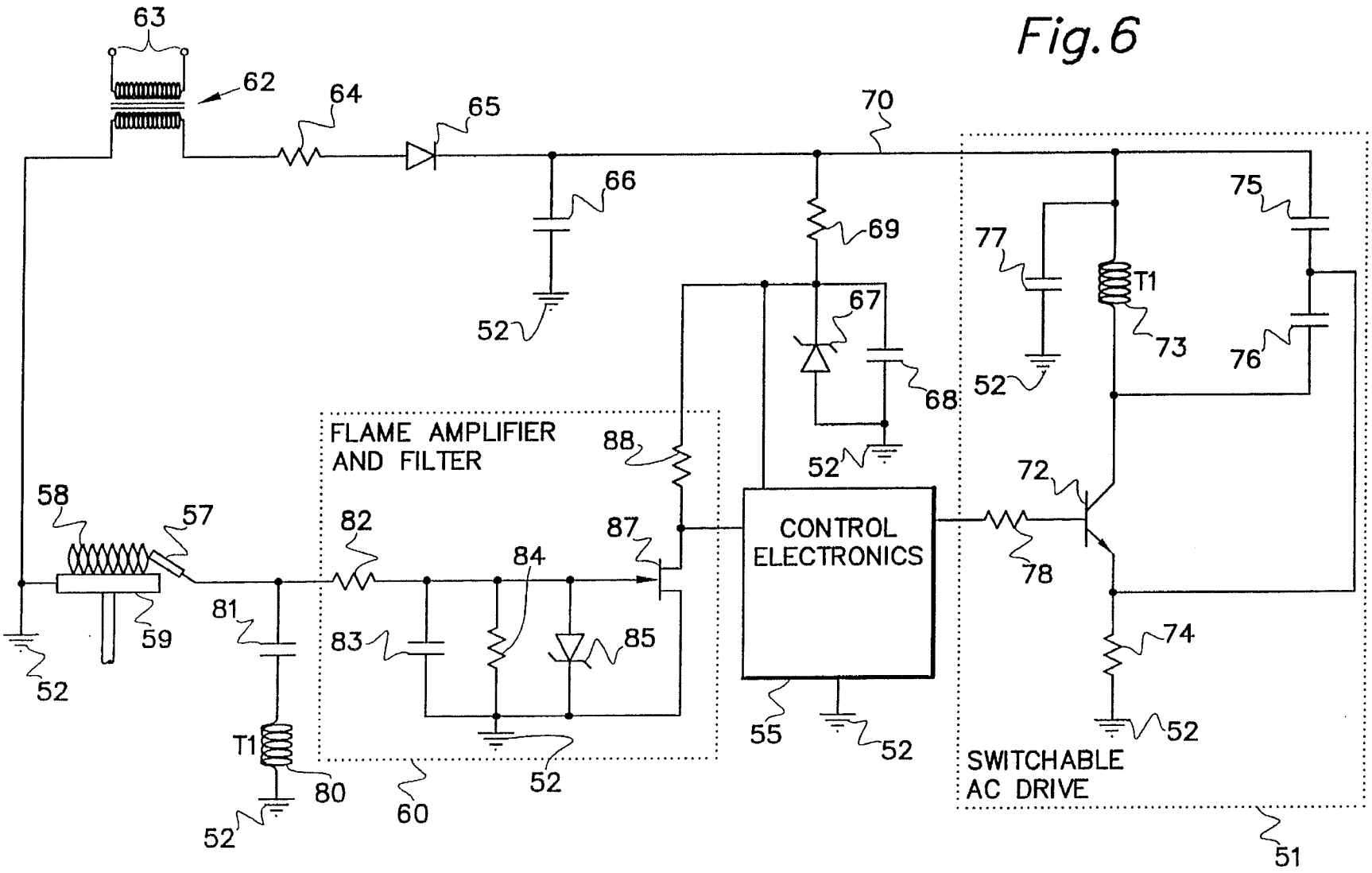
FIG. 6 is a circuit diagram of the flame sensor of FIG. 4.

The circuit diagram of FIG. 6 provides a more detailed representation of the flame sensor of FIG. 4. The same reference numerals are used to designate common elements in both Figures.

As illustrated in FIG. 6, electrical power for the sensor is provided through a step down transformer 62 whose primary winding may be connected to a suitable alternating current source, such as provided by an electrical utility, through a pair of terminals 63. A secondary winding of transformer 62 is connected between ground 52 and, through a resistor 64, to a simple half wave rectifier and filter circuit formed by a diode 65 and a capacitor 66. This primary power supply may, for example, be designed to produce approximately 34 volts DC which, for purposes of control electronics to be described hereinafter, may be further reduced to five volts DC by a low voltage power supply comprising a Zener regulator 67 having a filter capacitor 68 connected in parallel therewith in series with a resistor 69.

Switchable AC drive generator 51 is connected to be energized from the primary DC power supply through conductor 70. Generator 51 comprises a DC to AC converter designed to operate at 30 KHz, and to generate an output of approximately 200 volts AC. The generator is based on a Colpitts oscillator design comprising an NPN transistor 72 whose collector is connected to power supply conductor 70 through a primary transformer winding 73, and whose emitter is connected to ground 52 through a resistor 74. A pair of series connected capacitors 75 and 76 are connected across winding 73. The oscillator operates in a common base configuration, with positive feedback from the collector of transistor 72 to the emitter thereof through a voltage divider formed by capacitors 75 and 76. A bypass capacitor 77 between power supply conductor 70 and ground 52 prevents undesirable modes of operation which may occur when power supply impedances interact with the oscillator. The base electrode of transistor 72 is supplied with a square wave signal as will hereinafter be described through a resistor 78.

The series equivalent capacitance of capacitors 75 and 76, together with the inductance of primary winding 73, form a tank circuit of the oscillator, and establish the operating frequency. A secondary winding 80 of the transformer is connected through a capacitor 81 between probe 57 and ground 52. A suitable turns ratio of windings 73 and 80 provides the desired secondary winding voltage, which is applied to probe 57.

A positive enable signal from control electronics 55 supplied to the base of transistor 72 through resistor 78 establishes emitter current and puts transistor 72 into an active state, permitting oscillation startup. The DC emitter voltage also serves as a voltage clamp across capacitor 75, limiting oscillation amplitude at higher values of DC input voltage. This limits transistor power, and eliminates the need for heat sinking.

Due to the high frequency of the excitation supplied to probe 57, only a single pole low pass filter is required. This filter is formed by a resistor 82 and a capacitor 83 connected in series between probe 57 and ground 52. A resistor 84 connected across capacitor 83 drains the charge off the capacitor in the absence of a flame signal. A Zener diode 85 also connected across capacitor 83, limits the voltage thereacross to allow the charge to be quickly drained off the capacitor.

The signal at the junction of resistor 82 and capacitor 83 is supplied to the gate electrode of a FET 87, whose drain electrode is supplied with voltage from the low voltage power supply through a resistor 88, and whose source electrode is connected to ground 52. FET 87 serves to amplify the signal produced by the filter portion of filter/amplifier 60. The output signal of filter/amplifier 60 is taken from the drain electrode of transistor 87. This signal forms an input signal to control electronics 55, which may be implemented with a microprocessor to perform a variety of functions, including supplying a square wave control signal to drive generator 51. A flow diagram of the operation by which the signal is generated is provided in FIG. 7.

Figure 7:
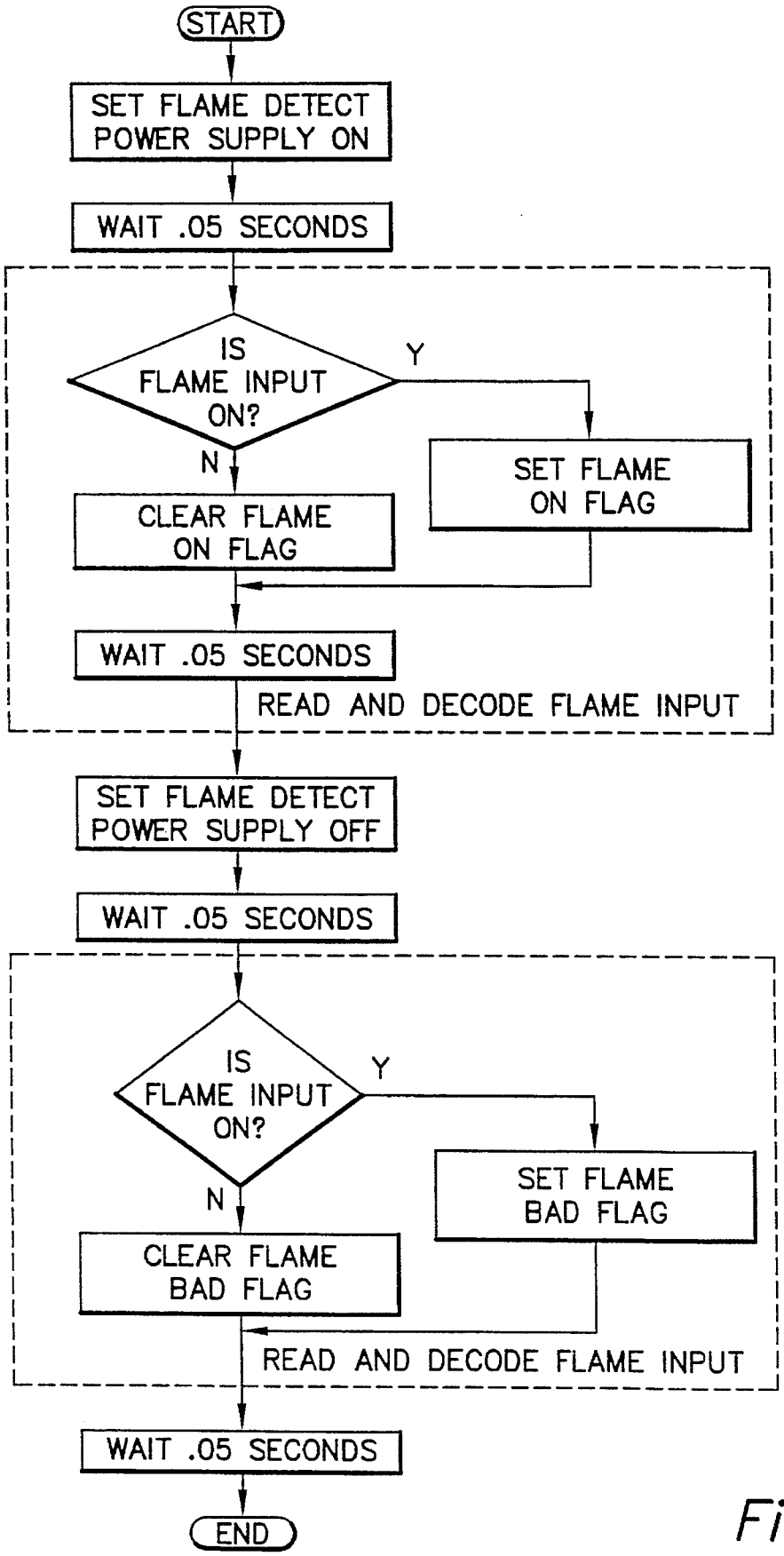
FIG. 7 is a flow diagram of certain logic operations accomplished in a portion of the circuit of FIG. 6.

In particular, as shown in FIG. 7, upon energization of the primary power supply, the output signal of control electronics 55 goes high. Thereafter, there is a 0.05 second delay, after which the control electronics determines whether filter/amplifier 60 is producing an output corresponding to a flame. This output is read and decoded to provide a flame indication. This indication is preliminary, pending confirmation, accomplished as follows, that filter/amplifier 60 is operating satisfactorily.

After another 0.05 second delay, control electronics 55 provides a low control signal to drive generator 51, thereby terminating its supply of excitation to probe 57. After another 0.05 second delay, control electronics 55 reads the output signal of filter/amplifier 60. If the filter/amplifier output signal corresponds to presence of a flame, control electronics 55 determines that the flame signal is erroneous, and that a critical component in filter/amplifier 60 has failed.

With reference to FIG. 5, waveform G illustrates the output of filter/amplifier 60 in proper operation. Waveforms G' and G" illustrate the outputs of filter/amplifier 60 if resistor 84 fails open and if transistor 87 fails open, respectively. In particular, if resistor 84 fails open, the charge on capacitor 83 is not bled off during the intervals between generation of successive pulses of alternating current, leaving a low voltage on the gate of transistor 87, and producing a continuously high output from filter/amplifier 60. Likewise, if transistor 87 fails open, the output of filter/amplifier 60 remains high regardless of actual flame status. Thus, the output signal of filter/amplifier 60 is very different if there is a failed component than for any valid flame signal.

The foregoing technique may be used to reduce the number of critical components required to construct a fail-safe flame detection circuit since redundant components are not required. In addition, critical component failure is detected immediately.

In accordance with the foregoing description, the applicants have provided a unique fail-safe flame detection circuit which does not rely on redundant components. Although a particular embodiment has been shown and described in detail for a illustrative purposes, coverage is not to be limited by the disclosed embodiment, but only by the terms of the following claims.

The embodiments of the invention in which an exclusive property or right is claimed are defined as follows:

1. Flame detection apparatus comprising:

a burner for sustaining flame in a flame region;

a reference electrode proximate the flame region;

an injector electrode positioned to transmit electric current through the flame region to said reference electrode, said injector electrode having an effective area smaller than the effective area of said reference electrode, whereby electric current rectification is effectively achieved by said reference and injector electrodes and flame in the flame region;

a signal generator for producing alternating voltage having a predetermined envelope;

connecting means for electrically connecting said signal generator between said reference and injector electrodes to supply the alternating voltage therebetween, whereby, when flame is present in the flame region, a signal having a substantially unipolar bias corresponding to the envelope is produced; and detector means connected to said injector electrode, said detector means being responsive to a signal having a substantially unipolar bias corresponding to the envelope, and operable in response to such a signal to indicate presence of a flame.

2. The flame detection apparatus of claim 1 wherein:

said signal generator is operable to produce periodic intervals of alternating voltage, the periodic intervals having a predetermined repetition rate; and said detector means is responsive to periodic intervals of alternating signal having a substantially unipolar bias and the predetermined repetition rate.

3. The flame detection apparatus of claim 2 wherein said detector means includes output means operable to indicate failure of a component within said detector means if an alternating signal having a substantially unipolar bias is produced during the time between production of successive intervals of alternating voltage by said signal generator.

4. The flame detection apparatus of claim 3 wherein said output means is operable to indicate presence of a flame only if an alternating signal having a substantially unipolar bias is produced during the time said signal generator is producing an interval of alternating voltage, and an alternating signal having a substantially unipolar bias is not produced during the time between production of successive intervals of alternating voltage by said signal generator.

5. In flame sensing apparatus of the type including a signal generator for impressing an alternating electrical signal between reference and injector electrodes adapted to cause electric current to flow through flame in a flame region, whereby the signal is rectified when a flame is present, the rectified signal being conditioned by a filter including a capacitor having a bleed resistor thereacross, the voltage on the capacitor being used to control amplifier apparatus whose output is indicative of presence or absence of a flame, improved means for detecting failure of critical components, including the capacitor, bleed resistor and amplifier device, in the filter and amplifier apparatus, comprising:

signal generator means for supplying to the injector electrode a pulse of alternating voltage; and logic means connected to receive the amplifier apparatus output, and operable to indicate failure of an electrical component in the filter or amplifier apparatus if the amplifier apparatus output indicates presence of a flame at any time except during the time a pulse of alternating voltage is being supplied by said signal generator means.

6. The flame sensing apparatus of claim 5 wherein said signal generator means is operable to supply periodic pulses of alternating voltage, the pulses having a predetermined repetition rate.

7. The flame sensing apparatus of claim 6 wherein said logic means is operable to indicate presence of a flame only if the amplifier apparatus output indicates presence of a flame during the time a pulse of alternating voltage is being supplied by said signal generator means, and the amplifier apparatus output does not indicate presence of a flame during the time between supply of successive pulses of alternating voltage by said signal generator means.

8. In flame detection apparatus of the type including a generator for supplying an alternating voltage signal to first and second electrodes adapted to produce substantially unidirectional electric current flow therebetween through an ionization region associated with a flame, and a detector for producing a flame indicating output in response to presence of substantially unidirectional electric current flow between the first and second electrodes, the improvement which comprises:

a generator adapted to produce an alternating voltage in packets having a predetermined envelope, the packets being produced at a predetermined repetition rate;

a filter for receiving the voltage between the first and second electrodes, said filter being formed of electrical components which, if functioning properly, produce a biased voltage signal corresponding to the envelope of the alternating voltage produced by said generator;

an amplifier responsive to the biased voltage signal produced by said filter to produce an output uniquely corresponding to the envelope of the alternating voltage produced by said generator only if the biased voltage signal corresponds to the envelope of the alternating voltage.

9. The flame detection apparatus of claim 8 wherein:

said generator is operable to produce periodic pulses of alternating voltage; and the biased voltage signal is produced by said filter only during the time said generator is producing a pulse of alternating voltage.

10. The flame detection apparatus of claim 9 wherein the frequency of the alternating voltage produced by said generator is greater than the repetition rate of the packets said alternating voltage.

11. A method of reliably detecting flame by means of a flame sensor whose operation is based on electrical rectification characteristics of a flame, the flame sensor including a signal filter and amplifier containing critical electrical components subject to failure which could result in an erroneous indication of presence or absence of a flame, the method of comprising the steps of:

supplying an input signal characterized by separated pulses of alternating voltage having a predetermined frequency to an electrode adapted to inject the input signal into a flame region;

conditioning the voltage present at the injector electrode by means of a filter which, in normal operation, substantially attenuates signal frequencies at the predetermined frequency to produce a voltage waveform corresponding to the pulse envelope of the input signal, the voltage waveform having a substantially non-zero value only when a flame is present and a pulse of alternating voltage is being supplied;

producing a preliminary flame detection signal during presence of a voltage waveform having a substantially non-zero value; and producing an indication of electrical component failure in the event the preliminary flame detection signal indicates presence of a flame during the time between supply of successive pulses of alternating voltage.

12. The method of claim 11, including the further step of producing a final flame indication signal only if the preliminary flame indication signal indicates presence of a flame during the time a pulse of alternating voltage is being supplied, and if the preliminary flame indication signal does not indicate presence of a flame during the time between successive pulses of alternating voltage.

* * * * *